United States Patent [19]

Menchetti

[11] Patent Number: 4,689,930

[45] Date of Patent: Sep. 1, 1987

[54] PARTITION STRUCTURE

[75] Inventor: Robert J. Menchetti, Buffalo, N.Y.

[73] Assignee: National Gypsum Company, Dallas, Tex.

[21] Appl. No.: 868,247

[22] Filed: May 29, 1986

[51] Int. Cl.[4] ..... E04B 1/348; E04B 1/56

[52] U.S. Cl. ..... 52/277; 52/276; 52/275; 52/468; 52/469

[58] Field of Search ..... 52/277, 276, 275, 272, 52/281, 461, 468, 469, 282

[56] References Cited

U.S. PATENT DOCUMENTS

| | | | |
|---|---|---|---|
| 2,040,385 | 5/1936 | Kellogg | 72/0.5 |
| 2,317,634 | 4/1943 | Olsen | 72/46 |
| 2,328,928 | 9/1943 | Sherron | 52/282 |
| 3,008,550 | 11/1961 | Miles et al. | 52/281 |
| 3,286,422 | 11/1966 | Pangerl | 52/287 |
| 3,543,463 | 12/1970 | Cannon | 52/282 |
| 3,603,056 | 9/1971 | Roth | 52/46 |
| 4,065,885 | 1/1978 | Blick, III et al. | 52/282 |
| 4,086,739 | 5/1978 | Hall | 52/281 |
| 4,192,113 | 3/1980 | Martin, Jr. | 52/282 |
| 4,258,519 | 3/1981 | Hugens | 52/282 |
| 4,385,850 | 5/1983 | Bobath | 52/461 |
| 4,434,900 | 3/1984 | Cook | 211/189 |
| 4,458,461 | 7/1984 | Holley | 52/282 |
| 4,539,243 | 9/1985 | Miller | 428/99 |

FOREIGN PATENT DOCUMENTS

| | | | |
|---|---|---|---|
| 531202 | 9/1954 | Belgium | 52/276 |
| 758286 | 1/1934 | France | 52/282 |
| 1336293 | 7/1963 | France | 52/282 |
| 2273139 | 12/1975 | France | 52/281 |

*Primary Examiner*—William F. Pate, III
*Assistant Examiner*—Michael Safavi
*Attorney, Agent, or Firm*—Robert F. Hause

[57] ABSTRACT

A partition wall in which a plurality of sections are adjoined by a plurality of vertically spaced apart hollow clips having a tightenable screw protruding from each to which a section of wall is to be affixed, with each screw head being placed through a hole in the web of a metal stud near the end of each wall section, with the screw head screwed tight against the stud web material.

4 Claims, 4 Drawing Figures

PARTITION STRUCTURE

FIELD OF THE INVENTION

This invention relates to a partition construction, and particularly to a combination of sections of partition adjoined by a plurality of clips, and the structure of the partition at such junctions.

BACKGROUND OF THE INVENTION

Non-progressive demountable partitions have been constructed heretofore with partition corners which are formed by extending one of the two walls forming the corner all the way to where the wall corner is desired and then abutting the end of the second wall against the side of the first wall, adjacent the end of the first wall. Preferably, the two walls would abut such that the wallboard on one side of the second wall overlapped the end of the first wall. A small angular elongate corner trim would then be affixed over the ends of the boards at the corner.

SUMMARY OF THE INVENTION

The present invention is directed to structure wherein two or more sections of a partition are connected by a plurality of clips of hollow short sections of extruded metal, each of which are connected to metal studs located at the ends of the partition sections, and each of which have means for affixing a partition height section of wall trim over the junction. A novel partition corner consists of two sections of partition disposed at 90° to each other, with each section having a metal stud located at or near the end of the section. Short hollow clips are affixed to each of the two end studs, as by screw heads engaging stud webs, preferably at three vertically spaced apart locations, affixing the two partition sections permanently in their closely spaced 90° relationship. An elongate piece of outside corner trim is then mounted over the outside corner thus formed and affixed to the clips, and an elongate section of inside corner trim is mounted over the inside corner thus formed and affixed to the clips.

It is an object of the present invention to provide an improved means for constructing partitions.

It is a further object to provide a novel clip for joining sections of partitions.

It is a still further object to provide an improved partition, having sections adjoined by a novel hollow short clip which engages adjacent metal studs.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
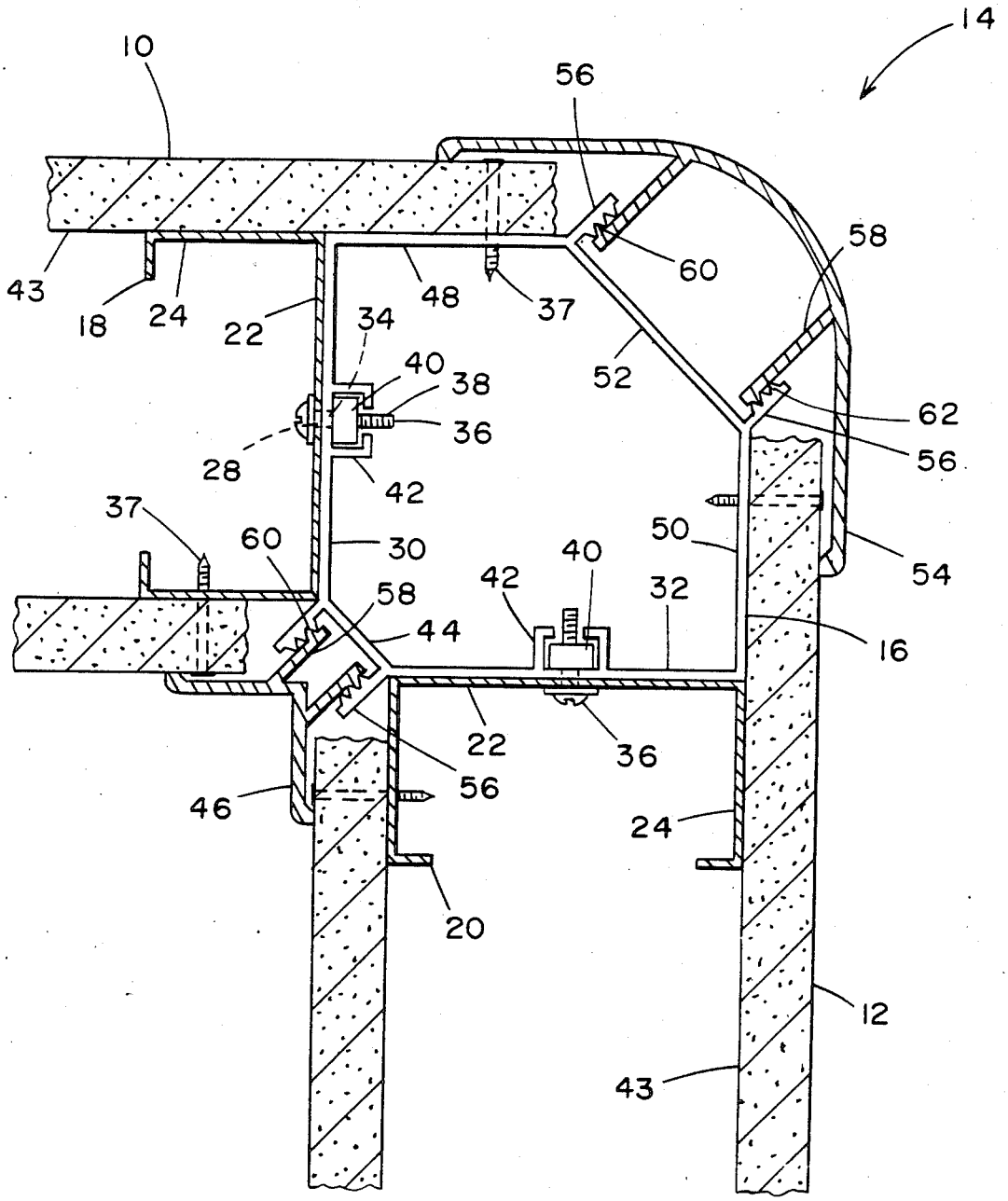
FIG. 1 is a horizontal sectional view of a partition corner constructed in accordance with the invention.
Figure 2:
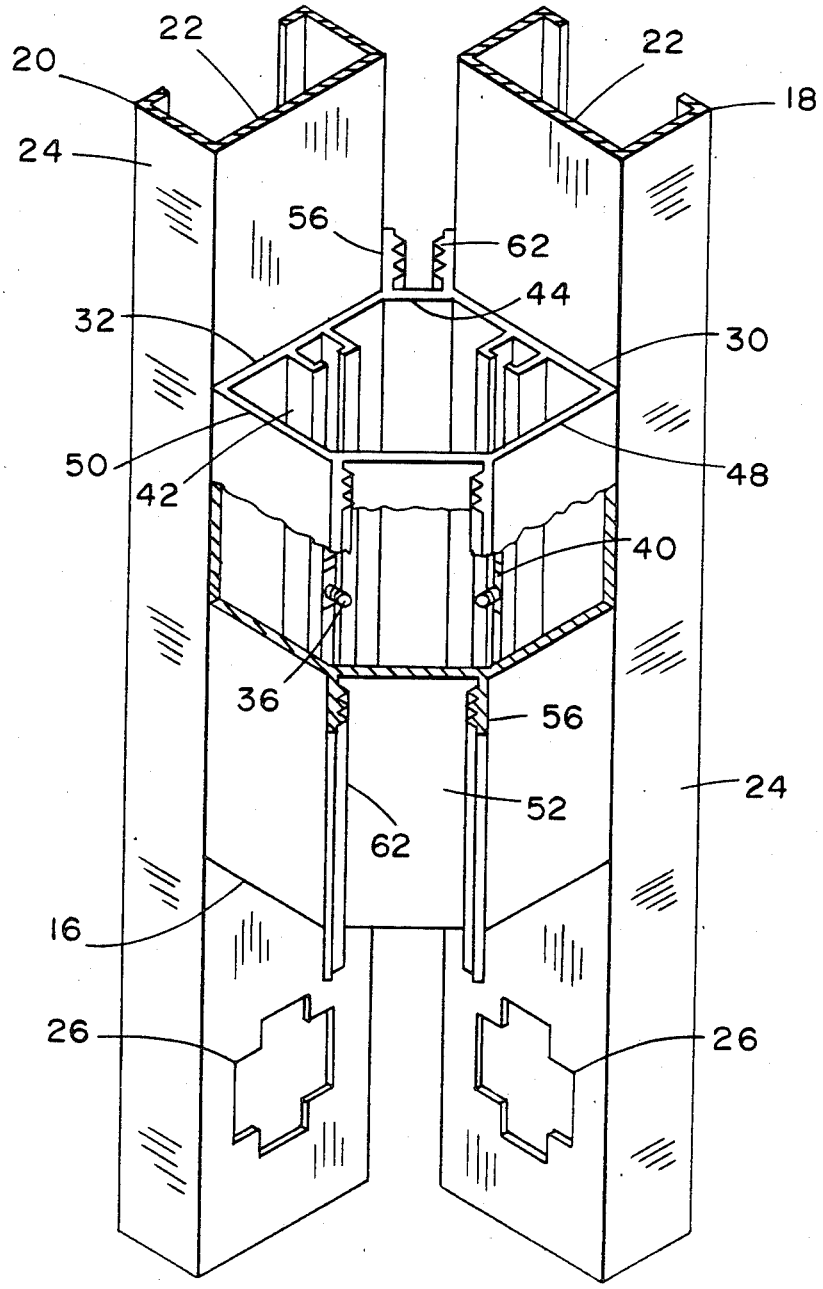
FIG. 2 is an isometric view of a pair of studs disposed at 90° to one another and adjoined by a novel hollow short clip, preparatory to applying wallboard and corner trim in the process of constructing the corner structure of FIG. 1.
Figure 3:
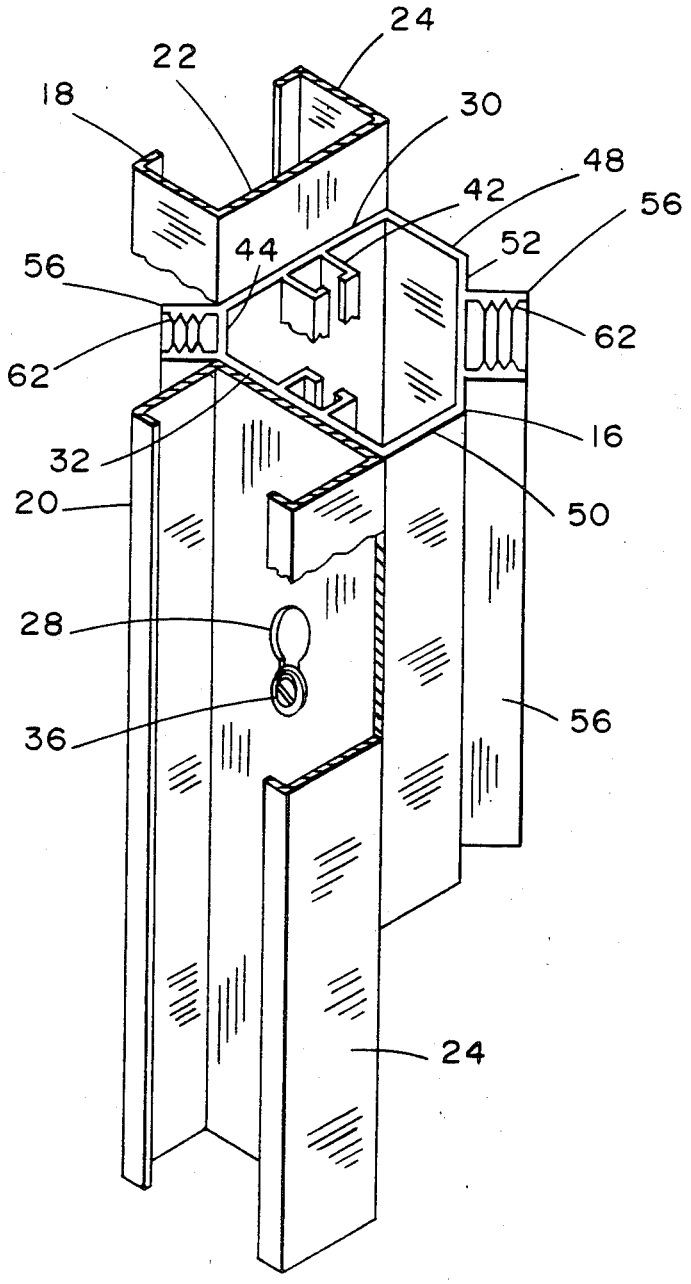
FIG. 3 is an isometric view of the studs and clip of FIG. 2 showing the attachment of the clip to web of a stud by a screw head inserted through a hole in the stud web.

Referring to FIGS. 1–3, there is shown a first partition wall 10 and a second partition wall 12 which are adjoined at a corner structure 14. Corner structure 14 includes three short hollow corner clips 16 (only one shown) which are located at vertically spaced positions in the corner structure, preferably spaced apart 29 inches, center to center.

Each clip 16 is attached to a stud 18 of wall 10 and to a stud 20 of wall 12, and thus clips 16 physically connect the two walls 10 and 12.

The studs 18 and 20 are of similar construction, each including a central web 22 and a pair of flanges 24 extending perpendicularly from each side edge of a central web 22. Central webs 22 have openings, or knockouts, 26 for passage therethrough of utilities or reinforcing channels, not shown. Webs 22 preferably have an additional small opening 28 located every 29 inches, which may be in the form of a keyhole.

Each clip 16 is a short section, about six inches long, of a thin walled aluminum extrusion, having two sides 30 and 32 disposed at a 90° angle one to the other. Approximately centered in each of the two sides 30 and 32 is a hole 34 through which extends a washer headed machine screw 36. The threaded end 38 of screw 36 extends inwardly of sides 30 and 32, and has thereon a square nut 40, which is restrained from being rotated when screw 36 is rotated by a pair of inwardly extending ribs 42.

The small openings 28 on each of studs 18 and 20 are located at equal heights, and each clip 16 is attached to the two studs 18 and 20 by inserting the heads of the two screws 36 through the openings 28 of the two studs. The clip 16 is then moved downward until the threaded end 38 engages the bottom of each opening 28. Screws 36 are then tightened in nuts 40, firmly locking together the clip 16 and the two studs 18 and 20.

Gypsum wallboard 43 is then applied to both sides of both walls 10 and 12, and screw 37 attached to the two studs 18 and 20, and the clips 16.

In the preferred embodiment, each clip 16 is formed of six sides. Connecting perpendicular sides 30 and 32 is a narrow diagonally extending side 44 having means for receiving and holding an elongate inside corner trim 46. The other half of clip 16 includes two perpendicularly disposed sides 48 and 50 between which there is a diagonally extending side 52 having means for receiving and holding an elongate outside corner trim 54.

The means for holding the inside corner trim 46 and the outside corner trim 54 includes a pair of outwardly extending, spaced apart, ratchet arms 56 on each of the diagonal sides 44 and 52 and a pair of inwardly extending barbed arms 58 on each of the corner trims 46 and 54. The barbed arms 58, in each combination, fit closely between the ratchet arms 56. Once engaged, the outwardly extending barbs 60 engage the inwardly extending ratchet teeth 62, and the corner trims 46 and 54 are relatively permanently held in place.

The ratchet teeth 62 have a height of about 0.030 inch and are located every 1/16 inch, providing adjustability to the placement of the corner trims 46 and 54 in case a vinyl or cloth sheet, to match the facings on the wallboard 43, is wrapped around the corner trim and under the side edges.

Each corner clip 16 consists essentially of a continuous wall, forming the six sides, which is of a thickness of about 0.050 to 0.060 inch. Ribs 42 and ratchet arms 56 have an average thickness of about 0.040 to 0.050 inch.

Figure 4:
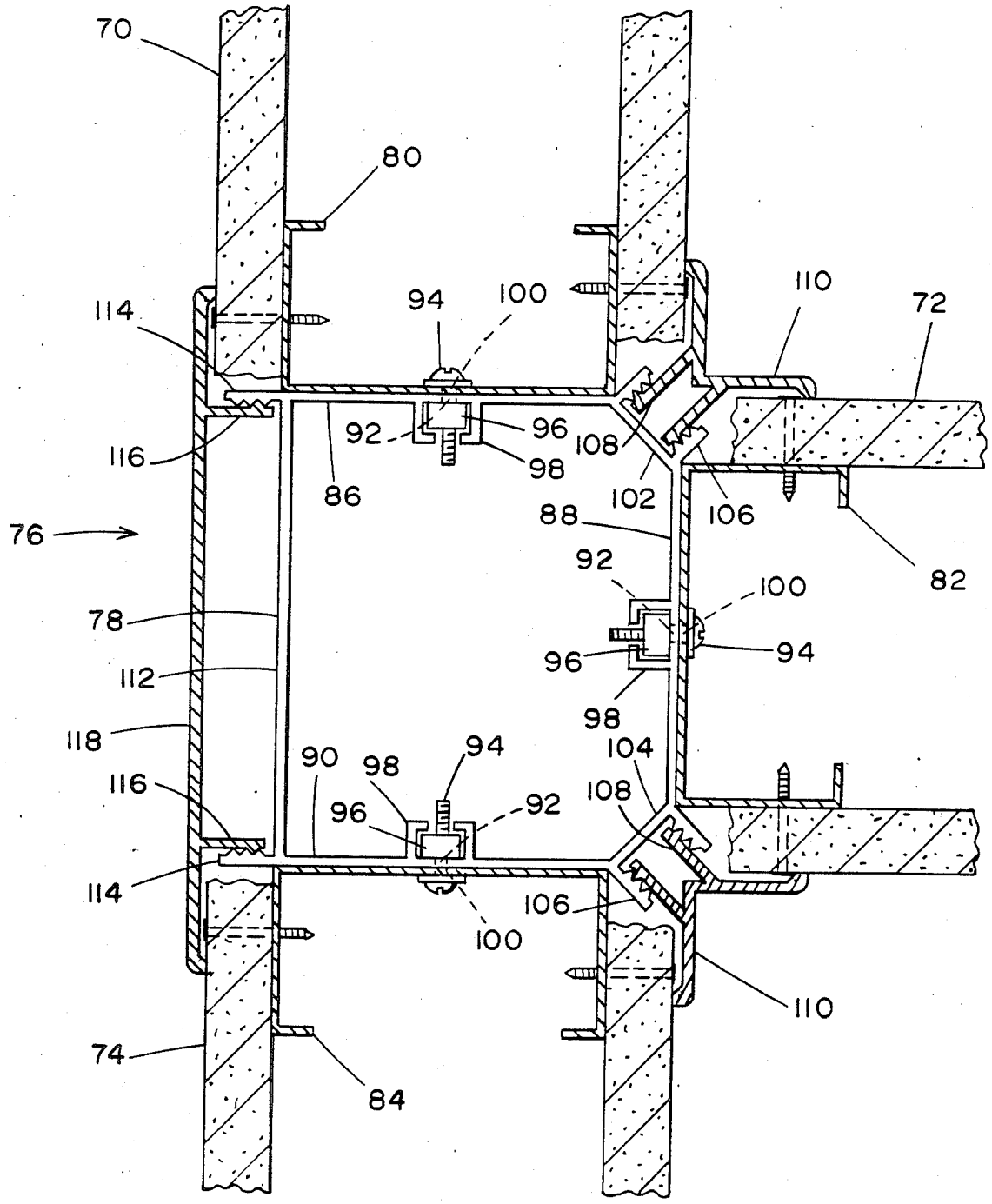
FIG. 4 is a horizontal sectional view of an intersection of one partition wall with the middle of a second partition wall.

Referring to FIG. 4, there is shown a first partition wall 70, a second partition wall 72 and a third partition wall 74, which are all adjoined at a wall intersection 76. Intersection 76 includes three short hollow intersection clips 78 (only one shown) which are located at vertically spaced positions in the intersection structure, preferably spaced apart 29 inches, center to center.

Each clip 78 is attached to a stud 80 of wall 70, to a stud 82 of wall 72 and to a stud 84 of wall 74. Clips 78 physically connect the three walls 70, 72 and 74, forming a 90° intersection of wall 72 with two walls 70 and 74, which are in line with one another.

Each clip 78 is a short section, about six inches long, of a thin walled aluminum extrusion having three sides 86, 88 and 90, each of which has a hole 92 through which extends a washer headed machine screw 94. The threaded end has a square nut 96 which is restrained from being rotated when screw 94 is rotated by a pair of inwardly extending ribs 98.

Small openings 100 on each of studs 80, 82, 84 are located at equal heights. Each clip 78 is attached to the three studs by inserting the heads of the three screws 94 through the openings 100 of the three studs. The clip 78 is then moved downward until the screw 94 engages the bottom of each opening 100. Screws 94 are then tightened in nuts 96, firmly locking together the clip 78 and the three studs 80, 82, 84. Gypsum wallboard is then applied to both sides of walls 70, 72, 74, and screw-attached to studs 80, 82, 84.

In the preferred embodiments, clip 78 has the three perpendicularly disposed sides 86, 88, 90 connected by diagonally extending sides 102, 104, each having a pair of outwardly extending, spaced apart, ratchet arms 106. Engaged between each pair of ratchet arms 106 are a pair of inwardly directed barbed arms 108 on each of two elongate inside corner trim 110.

On the opposite side of clip 78 there is a flat wall 112, with two opposed, outwardly directed ratchet arms 114, holding therebetween two inwardly directed barbed arms 116 of a flat elongate face trim 118.

Having completed a detailed disclosure of the preferred embodiments of my invention so that those skilled in the art may practice the same, I contemplate that variations may be made without departing from the essence of the invention or the scope of the appended claims.

I claim:

1. A clip for connecting a plurality of sections of partition wall, said clip comprising a relatively short length of a hollow tubular preformed rigid section of substantially uniform cross section, said preformed rigid section including a plurality of stud-engaging flat sides, each said stud-engaging flat side having means for first attachment to a stud of a partition wall section, said preformed rigid section further including at least two additional sides having means for firm attachment thereto of elongate clip-concealing trim strips, wherein said means for attachment to a stud in each stud-engaging flat side comprises a screw threadedly affixed to said clip with a screw-head located externally of said clip for engaging screw-head holding means of abutting studs, and wherein said means for attachment to a stud in each stud-engaging flat side further comprises a nut threadedly engaged by said screw and means for preventing rotation of said nut when said screw is rotated therein.

2. A clip as defined in claim 1 wherein said nut-rotation-prevention means includes at least one elongate inwardly-extending rib.

3. A partition wall comprising a plurality of sections adjoined together by a plurality of vertically spaced apart clips, each said clip being affixed to a vertical stud located at substantially the end of each of said plurality of sections of wall, said clips therein comprising a relatively short length of a hollow tubular preformed rigid section of substantially uniform cross section, said preformed rigid section including a plurality of stud-engaging flat sides, each said stud-engaging flat side having means for firm attachment to a stud of a partition wall section, said preformed rigid section further including at least two additional sides having means for firm attachment thereto of elongate clip-concealing trim strips, wherein said means for attachment to a stud in each stud-engaging flat side comprises a screw threadedly affixed to said clip with a screw-head located externally of said clip for engaging screw-head holding means of abutting studs, and wherein said means for attachment to a stud in each stud-engaging flat side further comprises a nut threadedly engaged by said screw and means for preventing rotation of said nut when said screw is rotated therein.

4. A partition wall as defined in claim 3 wherein said nut-rotation-prevention means includes at least one elongate inwardly-extending rib.

* * * * *

UNITED STATES PATENT AND TRADEMARK OFFICE

CERTIFICATE OF CORRECTION

PATENT NO. : 4,689,930

DATED : September 1, 1987

INVENTOR(S) : ROBERT J. MENCHETTI

It is certified that error appears in the above-identified patent and that said Letters Patent are hereby corrected as shown below:

Column 4, line 9: change "first" to ---firm---.

Signed and Sealed this

Twenty-third Day of August, 1988

*Attest:*

DONALD J. QUIGG

*Attesting Officer*

*Commissioner of Patents and Trademarks*